United States Patent [19]

Ross, Jr.

[11] 4,212,131

[45] Jul. 15, 1980

[54] HIGH UTILITY DISK TOY

[76] Inventor: Alexander D. Ross, Jr., 332 Sugartown Rd., B-32, Devon, Pa. 19333

[21] Appl. No.: 748,274

[22] Filed: Dec. 6, 1976

[51] Int. Cl.[3] ..... A63H 27/00

[52] U.S. Cl. ..... 46/74 D; 273/424

[58] Field of Search ..... 46/74 D, 75; 273/106 B

[56] References Cited

U.S. PATENT DOCUMENTS

| | | | |
|---|---|---|---|
| D. 183,626 | 9/1958 | Morrison | D34/15 |
| 3,580,580 | 9/1969 | Wark | 273/106 |
| 3,673,731 | 7/1972 | Farhl | 46/74 |
| 3,724,122 | 4/1973 | Gillespie, Sr. | 46/74 D |
| 3,855,728 | 12/1974 | Hynds | 46/74 D |

*Primary Examiner*—Russell R. Kinsey
*Assistant Examiner*—Mickey Yu

[57] ABSTRACT

A high utility disk toy for use in a multitude of indoor and outdoor games, comprising of a disk hull with a concave/convex surface with a central crown and dome and a peripheral horizontal rim wing flight stabilizer that extends outwardly from the base of the disk hull. In one embodiment of the invention the toy is molded or formed so that the three major parts, the disk hull, central crown and dome and the rim wing flight stabilizer are of a single piece construction with the same lightweight material. In an alternative embodiment of the invention the three major parts are made separately of the same or different materials in various shapes, sizes and colors. Said parts are then assembled by the users, to achieve desired results or to study and observe the effect of a part change on the spin or flight characteristics of a given unit. The new high utility disk toy can be placed on the tip of the finger and spun as a spinner or it can be inverted with the dome down and spun like a top on a smooth surface or it can be thrown and caught as a single unit or it can nest into or onto another or more of like design and can be thrown as a plurality of units that will separate in flight and fly the full flight in formation to the target area to be caught by one or a plurality of participants.

30 Claims, 22 Drawing Figures

HIGH UTILITY DISK TOY

BACKGROUND OF THE INVENTION

This invention relates to a combination of toys and more particularly to a combination of aerodynamic flying saucers and gyroscopic type tops and spinners. The popularity of throwing toys in the general configuration of saucers is well known as evident by the number of patents issued for same over the past decade. Three such patents are as follows:

| U.S. Pat. No. | Issued To | Issue Date | Title |
|---|---|---|---|
| 3,359,678 | Headrick | 12-26-67 | Flying Saucer |
| 3,673,731 | Farhi et al. | 7-4-72 | Reversible Aerodynamic Disc |
| 3,855,728 | Hynds | 12-24-74 | Aerodynamic Toy |

Although the above mentioned prior arts have individual qualities and characteristics they each have a limited utility.

The new high utility disk toy is unique in its simplicity of design and its high utility factor as will be apparent upon reference to the following specification, claims and drawings.

SUMMARY OF THE INVENTION

1. Brief Description Of The Invention

One embodiment of the present invention is comprised of a concave/convex, aerodynamically shaped disk hull with a central crown and dome, extending outwardly from the base of the disk hull is a peripheral horizontal rim wing flight stabilizer. Means for a surface extender is provided in the disk hulls outer surface by a series of concentric circular grooves extending into and below the disk hull's top relatively flat surface, and by a series of concentric irregular size steps, the peaks of which can be equally spaced, extending down the outer radius from the top's relatively flat surface to the horizontal rim wing flight stabilizer.

The inside surface of the central crown and dome is concave in shape with a smooth low friction surface so that a unit can be self centering and spin freely when caught or spun on the end of a finger.

In this embodiment of the invention the three major parts, i.e. the disk hull, central crown and dome and the horizontal rim wing flight stabilizer are made as one integral part, preferably by injection molding with a suitable thermoplastic material.

In another embodiment of the invention the integral units are made with a magnetic material and the units are charged in opposite directions.

In another embodiment of the invention as an educational tool in kit form the three major parts, i.e. disk hull, central crown and dome and the horizontal rim wing flight stabilizer are made separately of the same or different materials in various shapes, sizes and colors with various manufacturing techniques having a suitable quick acting means for joining the said parts together. An assembled unit could have a thin lightweight metal disk hull, a plastic molded central crown and dome and a cast rubber horizontal rim wing flight stabilizer.

2. Purposes Of The Invention

It is an object of the present invention to provide an improved high utility disk like toy that can be used in a multitude of indoor or outdoor games that would further develop the participants present skills and at the same time present new challenges and further encourage the development of new thought timing and coordination skills.

It is another object of this invention to provide from one die and a thermoplastic material a one piece integral toy that can be thrown and fly like a flying saucer or that can be spun on the end of a finger or that can be inverted and spun like a top. Said toy has an easy alternate grip for throwing and a simple self centering factor for spinning.

It is another object of this invention that the above mentioned toy can be used as dual integral units that for dual flights the units can be stacked and thrown as one, they will separate in flight, and have a full flight formation factor and can be caught by one or more persons, or for dual finger spin, the units can be spun on the end of a finger in each hand or for dual top spin, units can be inverted and spun like tops with each hand.

It is another object of this invention in an alternate embodiment, that the single integral units can be made of a magnetic material so that the units can be charged in opposite direction producing one unit with a top surface having a positive magnetic field and a bottom surface with a negative field. A second unit charged in the opposite direction having a negative top surface and a positive bottom surface.

When the above mentioned units are then used for dual flight they will have a quick positive means of separation at the moment of release, due to the like fields repelling each other. When used as a finger spinner, two units can be placed on top of one finger and spun, the first being supported by the finger the second by the opposing like fields, repelling each other.

It is another object of this invention in an alternate educational piece part kit form, consisting of an assortment of piece parts with a quick suitable snap-action means for connection. That said parts can be of various shapes, sizes, colors and materials but all parts having a standard configuration in the area of connection to its mating part, so that said parts can be interchanged quickly.

These and other objects of the present invention will become apparent upon reference to the following specifications, drawings and appended claims.

BRIEF DESCRIPTION OF THE DRAWINGS

FIGS. 6 thru 21 are component parts or component part assemblies showing the high utility disk toy in an educational kit form.

FIG. 6 is an elevation view of a rippled rim wing flight stabilizer as a component part.

FIG. 7 is an elevation view of a hollow rim wing flight stabilizer as an alternate component part.

FIG. 8 is a cross-sectional view of FIG. 7 a hollow rim wing flight stabilizer showing cavities for inserts.

FIG. 9 is a cross-sectional view of an assembled high utility disk toy showing a disk hull assembled with the rim wing flight stabilizer FIG. 8 and the crown and dome component part FIG. 11.

FIG. 10 is a cross-sectional view of a low profile crown and dome.

FIG. 11 is a cross-sectional view of a moderate profile crown and dome, having a magnetic insert.

FIG. 12 is a cross-sectional view of a high profile crown and dome.

FIG. 13 is a partial cross-sectional view of a hollow rim wing flight stabilizer with an insert locked in position with a high profile thin metal disk hull.

FIG. 14 is a partial cross-sectional view of a rim wing flight stabilizer having equally spaced horizontal cavities with a pressed fit magnetic insert and a medium profile disk hull showing an outer surface extender in the form of grooves and steps.

FIG. 15 is a partial cross-sectional view of a hollow rim wing flight stabilizer partially filled with water that is locked in place with a low profile disk hull.

FIG. 16 is a partial cross-sectional view of a solid rim wing flight stabilizer having a molded in place insert and a high profile metal disk hull.

FIG. 17 is a partial cross-sectional view of a low profile rim wing flight stabilizer and a medium profile metal or plastic disk hull, having both inner and outer surface extenders.

FIG. 18 is a partial cross-sectional view of a rippled rim wing flight stabilizer and a low profile metal disk hull.

FIG. 19 is a partial cross-sectional view of a rim wing flight stabilizer made with magnetic material having a positive field top side and a negative field bottom side positioned on a high profile disk hull.

FIG. 20 is a partial cross-sectional view of a rim wing flight stabilizer of magnetic material having a negative top side field and a positive bottom side field positioned on a medium profile disk hull.

FIG. 21 is a partial cross-sectional view of a rim bi-wing flight stabilizer on a low profile disk hull.

FIG. 22 is a side view of a magnetic spin probe.

DETAILED DESCRIPTION OF THE PREFERRED EMBODIMENTS

Figure 1:
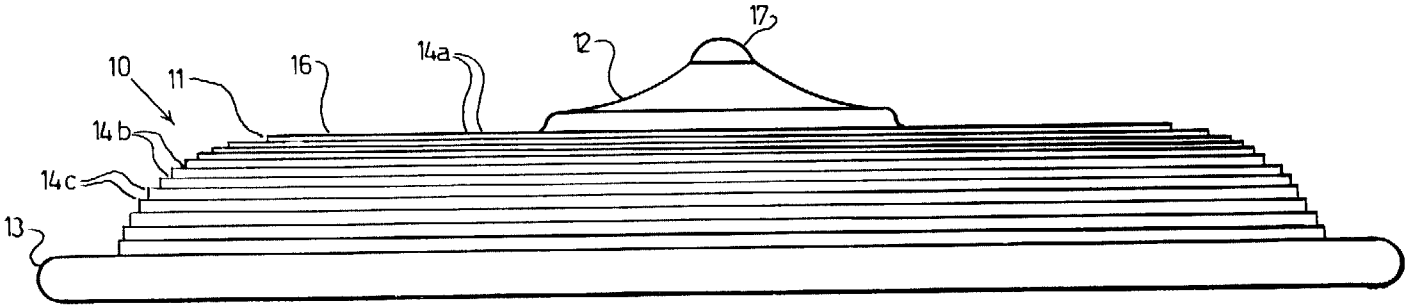
FIG. 1 is an elevational view of the high utility disk toy.
Figure 3:
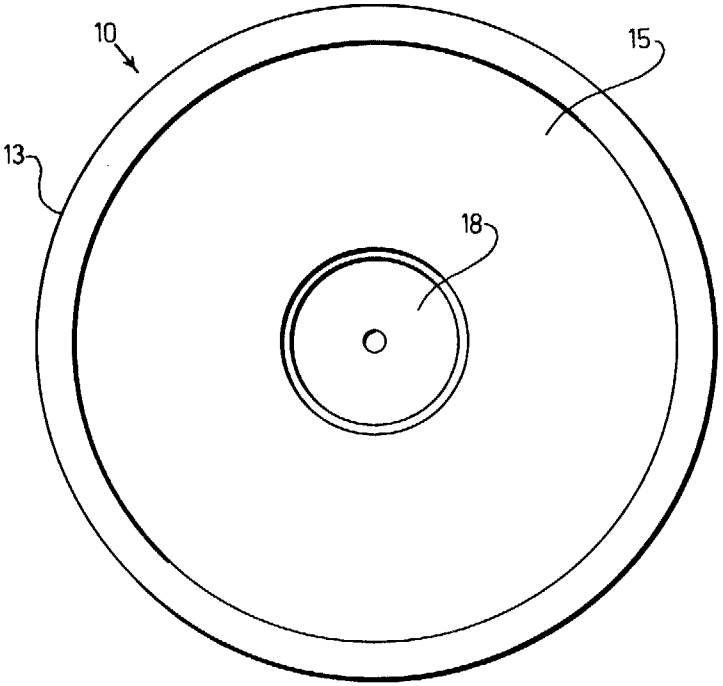
FIG. 3 is the bottom view or concave side of the toy.
Figure 2:
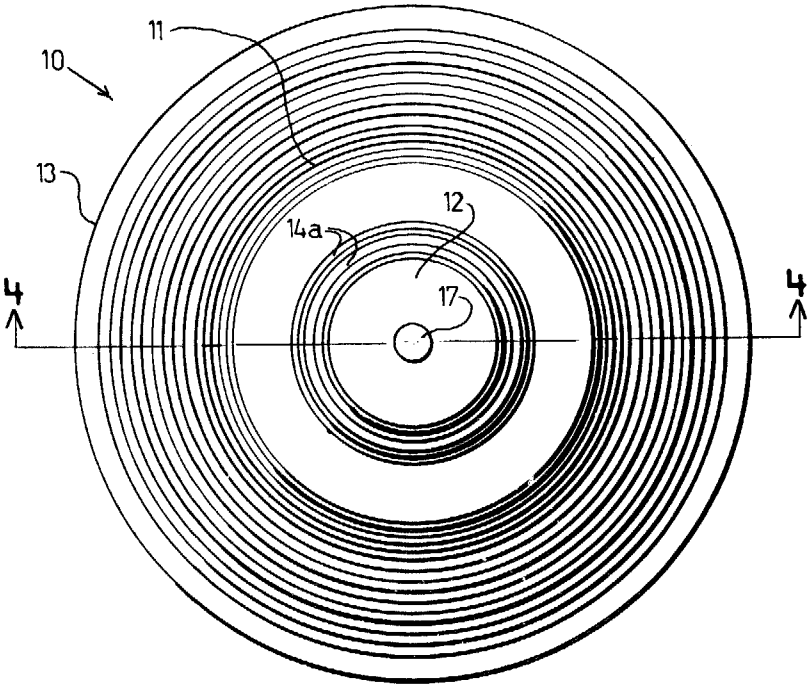
FIG. 2 is the top view or convex side of the toy.
Figure 4:
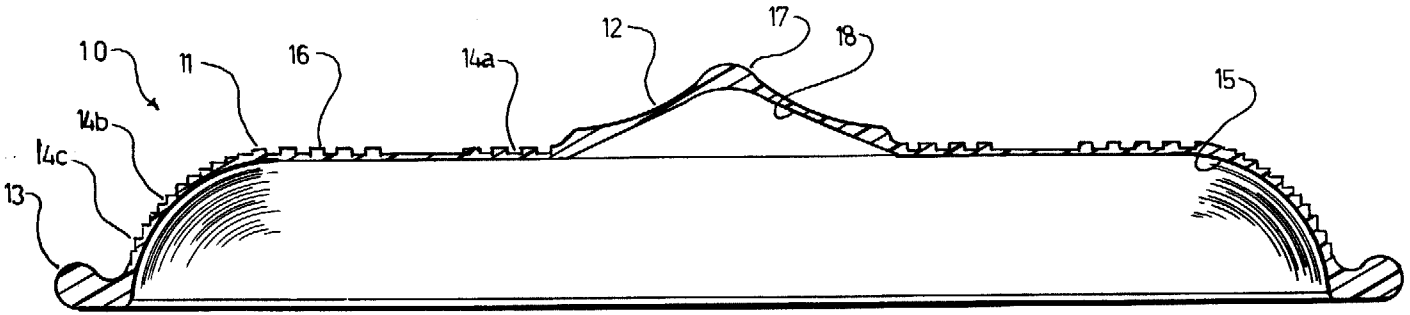
FIG. 4 is a cross-sectional view taken along the lines 4—4 of FIG. 2.
Figure 5:
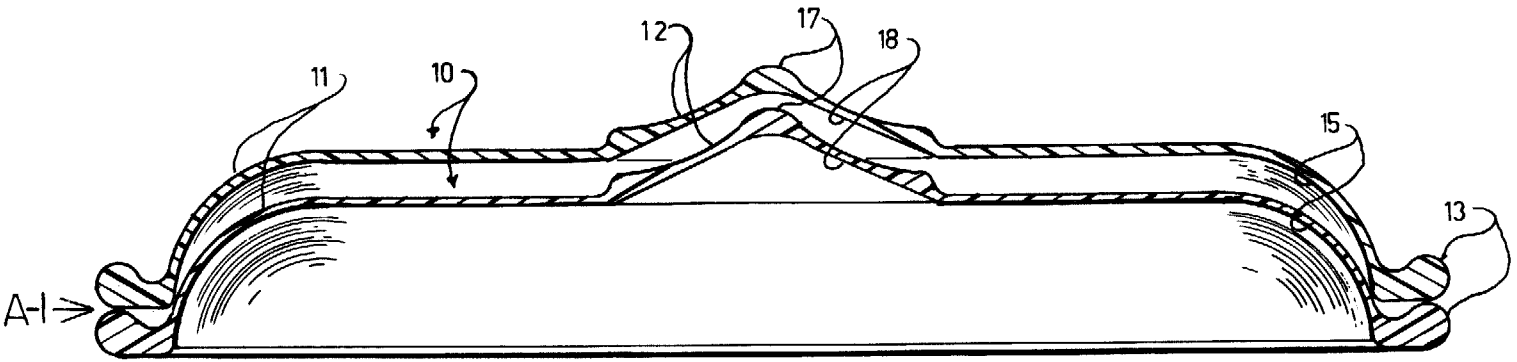
FIG. 5 is a cross-sectional view of two toys showing them in a stacked or nested position.

Referring now to FIG. 1, there is shown an elevational view of a high utility educational disk toy. The reference character 10 generally designates the toy comprising the present invention. Said toy includes a saucer-like concave/convex disk hull 11 having a central crown and dome 12 and a peripheral horizontal rim wing flight stabilizer 13 of a thicker cross-section that extends outwardly from the base of the disk hull 11. As an educational disk toy, so that flight characteristics can be observed and compared with and without surface extenders, means for same are provided by a series of concentric circular grooves **14*a* and a series of concentric irregular size steps 14*b*. The peaks 14*c* of which can be equally spaced. Both the concentric circular grooves 14*a* and the concentric irregular size steps 14*b* extend into and below the outer surface 16 of the disk hull 11. In comparison the disk hulls 11 in FIG. 5 are shown without said surface extenders 14*a*, 14*b* and 14*c***.

The inside surface 18 of the central crown and dome 12 is concave in shape with a smooth low friction surface so that a unit 10 can be self centering and spin freely when caught or spun on the end of a finger.

The outside surface 17 of the central crown and dome 12 is convex in shape and also has a smooth low friction so that the disk toy 10 can be inverted and spun like a top on a hard surface.

When used as an aerodynamic toy, the peripheral horizontal rim wing flight stabilizer 13 extending outwardly from the base of the disk hull has the following important facets.

1. In conjunction with the hull design 11, it permits stacking or nesting of the units, one into or onto another as in FIG. 5.
2. As stacked units, a plurality of units can be thrown as one for separation in flight.
3. The rim wing flight stabilizer 13 permits an easy separation of a plurality of units in flight.
4. In flight the rim wing flight stabilizer 13 produces a steady flight resisting roll over.
5. The rim wing flight stabilizer 13 permits an easier alternate grasp for throwing.
6. The thicker cross-section of the rim wing improves the rotational momentum in flight.
7. It is suspected that the rotating leading edge in flight breaks the wind permitting the unit to draft and thus producing longer flights.

In addition to the conventional throwing grasp of placing the thumb on the convex side 16 of the disk and one or more fingers on the concave side 15 where the thrower must release his grasp at the precise moment after uncoiling his throwing arm and snapping his wrist to impart momentum and a spinning motion to the disk. The new high utility disk toy has an easy alternate grasp that does not require the precise release time dexterity.

The easier alternate throwing grasp consist of pinching the rim wing 13 between the full length of the under side of the thumb and the first two or three fingers. Now when the disk 10 or disks are thrown as above the momentum of the forward thrust and the wrist snap imparted on the disk 10 causes the disk 10 to snap from the fingers due to the inertia force without the precise release time dexterity, imparting on said disk 10 a forward momentum thrust with a rotation movement about its central axis.

When the new high utility disk toys 10 are stacked, as in FIG. 5 and thrown as a plurality of units the rim wing flight stabilizer 13 are parallel to one another and to the line of flight. The opposing external force of air A-1 created by the throwing thrust penetrates between the spinning parallel rim wings flight stabilizer 13 and separates and disks one from the other. Since the disks are of the same size, weight, shape and density and have been thrown at the same time with the same momentum of forward spinning thrust the flight to the target area is at the same velocity and trajectory consequently the disk after separation in flight, fly in a relatively close formation over the full length of their flight so that the end of their trajectory they can be caught by one person.

This new multi disk full flight formation factor presents definite new challenges and will encourage or stimulate the development of new thought timing and coordination skills on part of the participants. The central crown and dome with a smooth inner and outer surface 18 and 17 adds to the utility of the disk.

An inverted disk 10 with the dome down can be spun on a smooth surface like a top. By placing the fingers on one hand into the concave side 18 with a slight down pressure and giving a quick twist of the wrist, it will cause the disk to spin like a top about its central axis. The length of spin time will vary depending on the skill of the participants. Spinning two disks 10 at the same time in the same or opposite directions adds to the challenge and to the degree of difficulty.

The single or multi inverted disk spins will present still new challenges and will encourage or stimulate still new thought timing and coordination skills.

Still added utility can be had by placing the disk 10 with the dome up on the tip of a finger. A quick sharp twist of the dome 12 with the fingers of the other hand will cause the disk to spin. By positioning the finger in the dome 12 so that the hard surface of the finger nail becomes the point of contact with the inner surface 18, the spin time is greatly enhanced. Again the speed or length of spin time will depend on the skill of the participant.

This new facet of being able to spin the disk 10 on the end of the finger opens up its use to a multitude of new games such as spin time, spin toss and transfer from one hand to the other or from one participant to another, double spin one in each hand, double transfer, spin and over the shoulder transfer, etc. This can all be done without the use of special probes, sticks, dowels, wands, etc., although they can be used if desired.

The single or double finger spin will present still new challenges and will indeed encourage or stimulate still new thought timing and coordination skills.

It is another object of this invention to provide additional means for flight stabilization by increasing the overall outside surface area of the disk hull through the use of surface extenders in the form of a series of concentric circular grooves **14*a* extending into and below the outer surface of said hull and a series of concentric irregular size steps 14*b* the peaks 14*c*** of which can be equally spaced.

The added surface area will tend to slow the disk's movement in flight but will improve its ability to hover and the general stabilization of said flights.

Referring now to the drawings and in particular to FIGS. 6 through 21, all of which are alternative embodiments shown the high utility disk toy in an educational piece part kit form, further showing component piece parts and component piece part assemblies. The high utility disk toy is produced in this fashion to further stretch the participant's imagination and present still new challenges and stimulate still new thoughts with the means to build, test, observe and compare the effects of changes in said piece parts in the flight and spin characteristics of the self assembled piece part units.

Figures 6, 7, 8, 9:
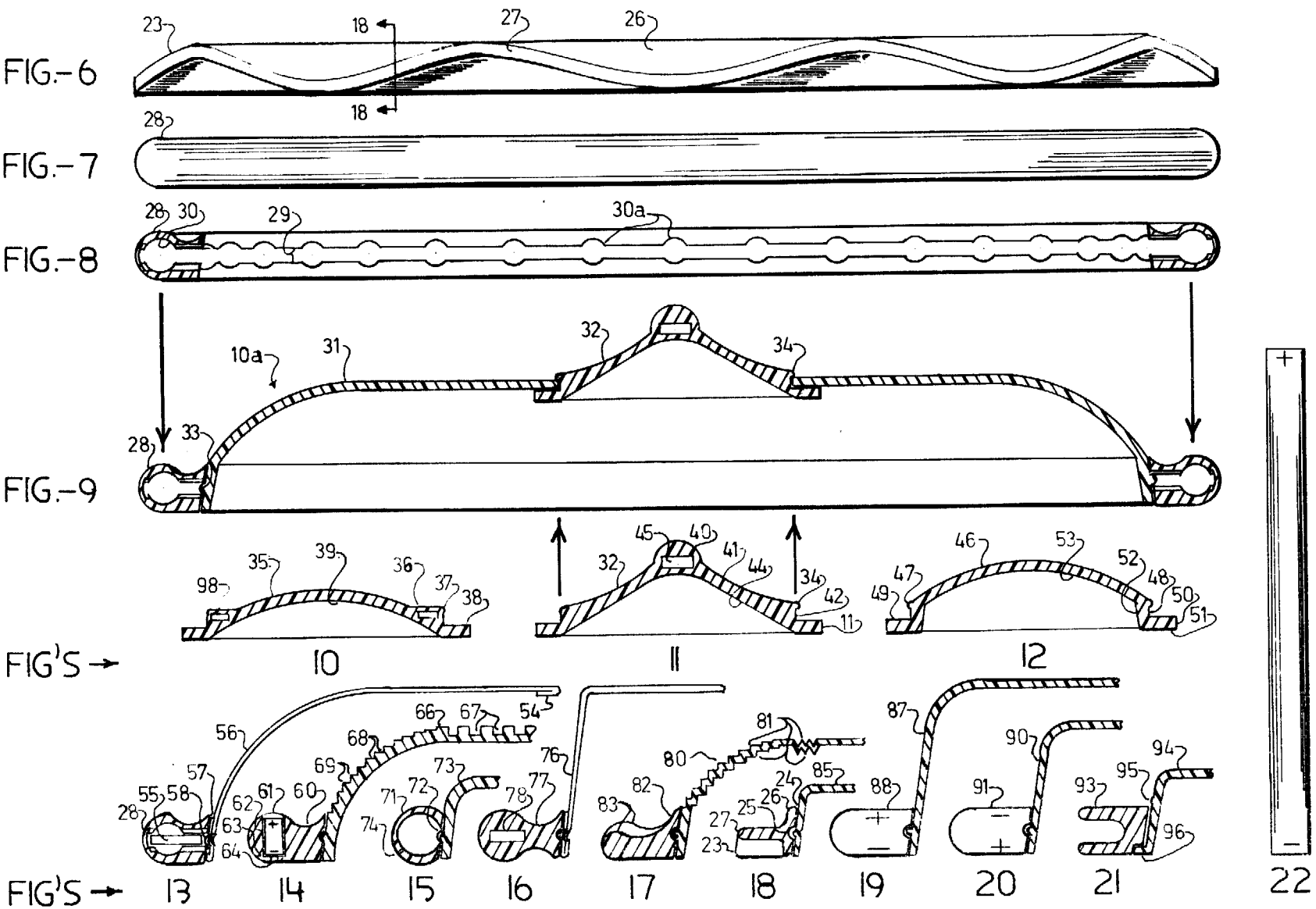

FIG. 6 is an elevation view of a rippled rim wing flight stabilizer 23 as a component piece part. It has a standard tapered inside perimeter 24 (that can be seen in FIG. 18 which is a partial cross-sectional view of said rim wing assembled to a disk hull). At a fixed distance from the bottom of the tapered perimeter it has a radius locking groove 25 that extends into and circumvents the tapered inside perimeter. Extending outwardly from the tapered inside perimeter 24 to a fixed outside diameter and also circumventing said part is a fixed wall 26 having a fixed thickness. Said wall has an outward wing like protrusion 27 that radiuses out from said outside wall 26 at various heights from its lower extremities to its upper extremities producing a rippled wing like protrusion that extends outwardly and radiuses to a fixed outside diameter.

Said rippled rim wing flight stabilizer can be used to hi-light a units rotational momentum or movement about its axis, in flight or when used as a spinner. In most disk like toys the said rotational movement is not usually readily discernable.

FIG. 7 is an elevation view of another rim wing flight stabilizer piece part that has a high utility factor in its self than can be better seen, described and appreciated in FIG. 8 which is a cross-sectional view of same.

FIG. 8 a cross-sectional view of the rim wing flight stabilizer shown as a component piece part in an elevational view in FIG. 7. It has the same tapered inside perimeter 24 described in FIG. 6 except that in place of the radius locking groove that is a fixed distance from said bottom this particular part has a locking slot 29 that extends deeply into the center portion of the said rim wing.

This particular rim wing is tube like in construction having an inner circular cavity extending completely around the inner portion of the rim wing. Said locking slot 29 extends into and out of the inner circular cavity 30. Equally spaced around the inner perimeter, are additional circular like cavities **30*a* extending into the rim wing to the same depth as the locking slot 29. All said cavities and the locking slot are provided in the rim wing so that inserts of various sizes, shapes and materials can be used to alter or change the flight or spin characteristics of an assembled unit. Said inserts will be locked in place when the rim wing is assembled to the disk hull 31 as shown in FIG. 9**.

FIG. 9 is a sectional view of an assemble unit 10A showing a disk hull 31 assembled to a rim wing flight stabilizer 28 and a central crown and dome 32 as can be readily seen the rim wing flight stabilizer 28 locks into place on the disk hull 31 by the locking slot 29 snapping over the raised dimple like protrusion 33 that extends outward from and around the outer perimeter of said disk hull. The central crown and dome 32 is also a press fit into the disk hull 31 and is locked into place by the locking ring 34 that is a raised dimple like protrusion slightly larger in diameter than the inner perimeter of the said disk hull 31.

FIG. 10 is a sectional view of a low profile crown and dome piece part that could be molded with magnetic materials and charged to produce positive or negative surfaces or could be molded with a magnetic ring insert 98. Said piece part being relatively flat with a slightly raised central convex outer surface 35 that extends outwardly to a relatively small circular flat plateau 36 that radiuses into the locking ring 37 that then extends down on a fixed outside diameter to the circular inner locking flange 38 that extends outwardly to a larger fixed diameter to the bottom surface that extends inwardly to a relatively low profile smooth concave inner surface 39.

FIG. 11 is a sectional view of a moderate profile crown and dome piece part having a molded in place magnetic insert 45 and a central convex dome 40 that extends down on a slightly concave surface 41 to the locking ring 34 that then extends down a perimeter, having a fixed diameter 42 to the circular inner locking flange 43 that extends outwardly to a larger fixed outer perimeter. The bottom surface extends from the outside flange perimeter inwardly to a smooth cone like inner concave surface 44 that tapers up to a relatively flat radius center. Said crown and dome FIG. 11 can be molded with or without the magnetic insert 45 or it could be molded with magnetic materials and charged to produce a positive or negative surface so that a unit assembled with said crown and dome FIG. 11 could be spun on the end of a finger or on a probe having a like magnetic field.

FIG. 12 is a sectional view of a high profile crown and dome piece part having a top convex surface 46 extending to the locking ring 47 that then extends down the outside wall 48 having a fixed diameter to the locking flange 49 that extends outwardly to its outer perimeter 50 with a fixed diameter then down to the bottom surface 51 that extends inwardly to a short slightly tapered inside wall 52 leading up to the inside concave surface 53.

FIG. 13 is a partial cross-sectional view of the rim wing flight stabilizer 28 shown in FIGS. 7, 8 and 9 that can be made of a ridged, semi ridged or flexible material with a horizontal insert 55 locked in place, by a high profile lightweight metallic disk hull 56 that has a spun or rolled inner rim 54 and a spun or formed self strengthening outer rim 57 made by forming or spinning its outer edge back upon its self and having a formed or spun dimple like protrusion 58 that extends outward from and around the outer perimeter of said disk hull. When the rim is pressed down over the disk hulls outer radius the dimple like protrusion locks into the rim wings locking slot, thus sealing or locking the rim wing inserts in place.

The inserts designed to fit the cavities can be of various shapes and sizes, they can be made of various magnetic or non magnetic materials and can be used to alter and study the changes in the flight and spin characteristics of a given unit.

FIG. 14 is a partial cross-sectional view of another disk hull, rim wing flight stabilizer combination. This particular rim wing 60 is shown with a horizontal magnetic insert 61 that is press fit by hand into cavities 62 that are equally spaced around the top perimeter of said rim. Said cavities 62 extending down to a shoulder 63 at its lower extremities and having a smaller cavity 64 then extending through the bottom base of said rim wing. Said smaller cavity 64 is used when removing the inserts 61. Pressure applied to a small diameter probe placed in the cavity 64 will expel the said inserts.

The disk hull 66 is made of molded plastic material like the disk hull 31 shown in FIG. 9 except that this disk hull has a larger outer surface area provided by a series of concentric circular grooves 67 extending into and below the disk hull's top relatively flat surface and by a series of circular concentric irregular size steps 68 that extend into and around the outer surface and down the outer radius having peaks 69 of which can be equally spaced. Said steps terminating at the smooth tapered mounting surface for the rim wing flight stabilizer.

FIG. 15 is a partial cross-sectional view of still another disk hull and rim wing flight stabilizer combination. This particular rim wing flight stabilizer 71 is made with a flexible material and is tubular in construction having a side opening 72 that is sealed when assembled to a disk hull. This particular disk hull 73 is of a molded polyethylene low profile variety. By partially filling the tubular rim wing with water, (simply done by assembling said rim wing to the disk hull while it is partially submerged) new and interesting changes in the flight and spin characteristics of the units will be found due to the constant changes in its weight distribution while in flight or spinning.

This new factor will present still new challenges and open new doors to adventure in the exploration of ways to control such flights.

By adding small exhaust ports 74 (pierced angled holes equally spaced around the lower perimeter that are normally closed) the disk toy can be used as above or a chemical substance such as sodium bicarbonate can be added to the water. The ensuing pressure escaping from said ports in flight will assist the lift and the rotational momentum of the spin about its axis, producing longer flights, adding still another dimension (power assist) to its use as an educational tool.

FIG. 16 is a partial cross-sectional view of still another disk hull, rim wing flight stabilizer combination. Showing another variation of a high profile thin metal disk hull 76 having a rolled inner and outer edge assembled to another variation of a rim wing flight stabilizer, this particular rim wing flight stabilizer 77 being of a solid construction that could have a molded in place magnetic ring insert 78. Said rim wing flight stabilizer 77 has the same standard size tapered inner perimeter and locking cavity used to lock the rim wing to the various disk hulls. This particular rim wing 77 has an hour glass like configuration where the top and bottom surfaces extending from the tapered inner perimeter radiuses inwardly to produce a thinner cross-section then outwardly to a rounded outside perimeter. This particular rim wing 77 with its upper and lower curvatures provide an ideal grasping area for throwing and spinning.

FIG. 17 shows a partial cross-sectional view of still another disk hull rim wing flight stabilizer combination showing a moderate profile disk hull 80 that can be made of thin metal or of a molded plastic material having a pleated or accordion like appearance, producing peaks 81 on both the inner and outer surfaces of said disk hull. The said accordion like appearance extending from a short relatively flat inner perimeter, connecting area, for the central crown and dome (not shown) to the disk hulls standard size tapered outer perimeter having the fixed position dimple like protrusion extending outwardly and around the said outer perimeter. This particular rim wing flight stabilizer 82 has the same standard size tapered inner perimeter and locking cavity. Extending outwardly from the base of said taper is a relatively flat bottom surface that at a fixed diameter then radiuses up to an undulating top surface 83 that in turn radiuses to the top of said taper. Said undulations providing a comfortable grasp for throwing and spinning and makes the rotational movement of the disk more readily discernable.

FIG. 18 is a partial cross-sectional view of the rippled rim wing flight stabilizer 23 shown in FIG. 6 that is assembled to a low profile disk hull 85 that could be made of a formed thin metal or of a molded plastic. The rim wing flight stabilizer 23 is made of molded plastic and has the same standard size locking cavity 25 and tapered inner perimeter 24. It is sleeve like in construction having an outside wall 26 of a fixed diameter. Extending outwardly from said outside wall in an undulating wave like pattern wing like protrusion 27 of a thinner cross-section that extends outwardly to its rounded outer undulating perimeter.

As the rim wing described in FIG. 17 the said undulations provide a comfortable grasp for throwing and spinning and makes the rotational movement of this disk assembly even more readily discernable since it has two undulating surfaces.

FIG. 19 is a partial cross-sectional view of still another disk hull, rim wing flight stabilizer combination. Said disk hull 87 being of a high profile molded plastic variety having a central opening not shown for the insertion of a central crown and dome. Said disk hull has a deep dish like configuration with its outer wall extending down to a standard fixed taper and taper lock mound extending around its perimeter. The rim wing flight stabilizer 88 has the same standard size tapered inner perimeter and locking groove. Said rim wing flight stabilizer 88 has a parallel upper and lower surface extending outwardly from said tapered inner perimeter to a fixed distance then radiuses into a smooth rounded outside perimeter. Said rim wing is molded with magnetic materials and charged so that the upper surface has a positive magnetic field and its lower surface has a negative magnetic field.

FIG. 20 is a partial cross-sectional view of still another disk hull, rim wing flight stabilizer combination said disk hull 90 being of a medium profile molded plastic variety having the standard mounting taper. The rim wing flight stabilizer 91 is of the same style, size, shape and weight as 88 shown in FIG. 20 except that its magnetic materials have been charged so that it has top surface with a negative field and a bottom surface with a positive field. When the two rim wing flight stabilizers 88 and 99 shown in FIGS. 19 and 20 are assembled to similar disk hulls having similar crown and domes and stacked for a dual flight said units will have to be forced together due to the like magnetic fields opposing each other. At the moment of release said magnetic fields will cause an instant separation. Normally two non magnetic disk assemblies of the same size and shape stacked and thrown together would have the same forward spinning thrust and they would fly at the same velocity and trajectory to the target area in a relatively close formation flight. Any repeatable variances from said predictable flight pattern over a set course of flight with disks or disk assemblies having opposing magnetic fields would probably be due to the reaction caused by the disks opposite magnetic fields being in harmony or disharmony with the earth's magnetic field in said target area.

Due to the magnetic disk's relatively lightweight in flight, it is suspected or deemed highly probable tht the earth's north, south mangetic field will influence to some degree a variance from norm of said flight pattern when compared with a non magnetic disk of like size, weight and shape.

The exciting exploration of this new probability of the earth's magnetic field and its effect on the magnetic disk's flight pattern will present still new challenges for the participants and further encourage the development of their thought timing and coordination skills.

When two disk assemblies are assembled using the high peaked central crown and dome FIG. 11 with two high profile disk hulls 87 as shown in FIG. 19 with the two rim wing flight stabilizers 88 and 91 shown in FIGS. 19 and 20 said units can be placed on top of one finger and spun. The first unit being supported by and spun on a finger tip placed into the self centering concave surface of its central crown and dome. The second unit will be suspended directly above said first disk being supported vertically by the like magnetic fields of the rim wing flight stabilizers repelling each other and held laterally from slipping off by the side walls of said disk hulls. The toss and transfer of said spinning assemblies from the finger of one hand to a finger of the other becomes exceedingly more difficult due to the inner play of the like magnetic fields.

The toss and transfer of said dual disk presents still new challenges and will further encourage the development of new thought, timing and coordination skills.

FIG. 21 is a partial cross-sectional view of still another rim wing flight stabilizer disk hull assembly showing a dual wing rim wing flight stabilizer 93 assembled to a low profile disk hull 94 and showing an alternate locking means consisting of a raised dimple like protrusion 95 at the smaller diameter end of the standard taper and an outwardly protruding flange 96 at the larger diameter end of said taper. When the rim wing flight stabilizer 93 having a recess for the disk hulls outwardly protruding flange is pressed into position over the top of said hull it is securely locked in position by said protruding flange and dimpled protrusion that are extending outwardly and around the outer perimeter of the disk hull.

From the foregoing it should be evident that the present invention has provided a high utility educational spinner and flying toy. The first described embodiment of the present invention provides completed units fabricated by injection molding of a polyethylene material. The second described embodiment provides completed units fabricated with magnetic materials and charged to produce a positive or negative top surface and an opposite bottom surface the third embodiment of the present invention is in an educational piece part kit form. Where as said piece parts are quickly changeable (snap on snap off construction) fabricated for special effects or comparison test with various metalic and plastic materials using suitable manufacturing procedures.

The provided toys achieve the objects of the invention as described using specific terms, such description is for illustrative purposes only and it is to be understood that changes and variations may be made without departing from the spirit or scope of the following claims.

What is claimed is:

1. A high utility disk toy adapted to be thrown through the air, spun on a finger or spun like a top, that can be stacked (having seventy-five percent or more of its height fitting into or over another) that can be thrown as one, with in flight separation and having a full flight formation factor, comprising:

a. a concave/convex central dome having a smooth sloping surface extending down to;

b. an intermediate crown that radiuses into;

c. a rounded peripheral concave/convex disk hull that extends outwardly and then down on a larger radius to;

d. a flat bottom horizontal rim wing flight stabilizer that extends outwardly at right angles from the base of the disk hull to its outer rounded perimeter.

2. A disk toy according to claim 1 wherein the central dome and crown, disk hull and the horizontal rim wing flight stabilizer are fabricated as one, of one material as a single integral unit.

3. A disk toy according to claim 1 having surface extenders in the form of grooves and steps extending into and around said surface.

4. A disk toy according to claim 3 that extends the surface area and reduces the weight of said part.

5. A disk toy according to claim 3 wherein the grooves are equally spaced.

6. A disk toy according to claim 3 wherein the peaks of said steps can be equally spaced.

7. A disk toy according to claim 1 wherein the rim wing flight stabilizer is substantially thicker than the disk hull and the central crown and dome.

8. A disk toy according to claim 1 wherein the cross-section of the rim wing flight stabilizer is a shape approximating the cross-section of an airplane wing.

9. A disk toy according to claim 1 wherein the rim wing flight stabilizer has a thicker rounded leading edge producing a rounded annular trough extending circumferencially around said toy between the rounded leaping edge and the disk hull.

10. A disk toy in accordance with claim 1 wherein the central dome has a smooth rounded outer surface.

11. A disk toy in accordance with claim 1 wherein the central crown and dome has a smooth inner surface.

12. A disk toy in accordance with claim 11 wherein the smooth inner surface of the central crown and dome has a configuration of a rounded taper having a radius of curvature at the small diameter end of said taper.

13. A disk toy in accordance with claim 12 wherein said radius of curvature is greater than the radius of curvature of a large thumb.

14. A disk toy in accordance with claim 1 wherein said disk toy has a top and bottom surface of opposite magnetic fields.

15. A disk toy in accordance with claim 1 wherein said concave/convex central dome and crown, said concave/convex disk hull and said horizontal rim wing flight stabilizer are separate piece parts that are removable and wherein means is provided for releasably retaining said piece parts whereby when so desired to alter the spin or flight characteristics said piece parts can be removed and replaced by other having a different configuration but having the same releasably retaining means.

16. A disk toy in accordance with claim 15 wherein said concave/convex disk hull piece parts of various configurations and materials have an inner perimeter defining a fixed central circular opening and a circular lower outer perimeter defining a fixed taper.

17. A disk toy in accordance with claim 15 wherein said concave/convex central dome and crown piece parts of various configurations and materials have a fixed outer perimeter with a hand press fit means provided for releasably retaining said dome and crown piece parts in the fixed central circular opening of the disk hull piece parts.

18. A disk toy in accordance with claim 15 wherein said horizontal rim wing flight stabilizer piece parts of various configurations and materials have a standard fixed inner perimeter defining a fixed central circular opening in the form of a fixed taper with a hand press fit means provided for releasably retaining said piece part on the fixed taper circumventing the outer perimeter of the disk hull piece parts.

19. A disk toy in accordance with claim 18 wherein said horizontal rim wing flight stabilizer piece parts of various configurations and materials can be of a solid structure or hollow structure having cavities to receive and lock in place magnetic or non magnetic inserts.

20. A disk toy in accordance with claim 19 wherein said horizontal rim wing flight stabilizer of a hollow structure and a flexible material has pierced angled exhaust ports.

21. A disk toy in accordance with claim 20 wherein water and sodium bicarbonate can be entrapped in the hollow structure and the ensuing pressure escaping from said ports in flight will give a power assist to the lift and rotational momentum producing longer flights.

22. A disk toy in accordance with claim 18 wherein said horizontal rim wing flight stabilizer piece part is made of magnetic material and charged so that its upper and lower surfaces have opposite magnetic fields.

23. A disk toy in accordance with claim 22 wherein the opposing force of like magnetic fields repelling each other is used for quick separation on dual flights and as a supporting force in dual spins.

24. A disk toy in accordance with claim 18 wherein said horizontal rim wing flight stabilizer piece part has an undulating or rippled wing.

25. A disk toy in accordance with claim 16 wherein said concave/convex disk hull piece parts can be of a high, medium or low profile variety made of a lightweight metal or plastic material having a smooth or irregular inner and outer surface.

26. A disk toy in accordance with claim 17 wherein said concave/convex central dome and crown piece parts can be of a high, medium or low profile fabricated with lightweight materials having a smooth inner and outer surface.

27. A disk toy in accordance with claim 17 wherein said concave/convex central dome and crown piece part is molded with a magnetic material a charge to produce a positive or negative top surface.

28. A disk toy in accordance with claim 17 wherein said concave/convex central dome and crown piece parts have magnetic inserts molded or pressed in place wherein when spun on a probe having a magnetic tip with a like magnetic field said disk will be suspended above said probe and spin freely.

29. A disk toy in accordance with claim 28 wherein a rod magnet can be used as a spinning probe.

30. A disk toy in accordance with claim 17 wherein the hand press fit means comprises a snap-on snap-off interference fit.

* * * * *